United States Patent [19]

Rochman

[11] 4,141,194

[45] Feb. 27, 1979

[54] MACHINE FOR PACKAGING CHICKENS

[76] Inventor: Zur Rochman, 53 Hashmonaim St., Tel-Aviv, Israel

[21] Appl. No.: 835,117

[22] Filed: Sep. 20, 1977

[30] Foreign Application Priority Data

Feb. 2, 1977 [IL] Israel ..... 51377

[51] Int. Cl.[2] ..... B65B 63/02; B65B 43/36

[52] U.S. Cl. ..... 53/529; 53/138 A; 53/572; 53/385

[58] Field of Search ..... 53/189, 138 A, 187, 53/260, 385, 124 D

[56] References Cited

U.S. PATENT DOCUMENTS

| | | | |
|---|---|---|---|
| 1,637,509 | 8/1927 | Allat | 53/138 A X |
| 3,698,153 | 10/1972 | Lieberman | 53/189 X |
| 3,822,527 | 7/1974 | Germunson et al. | 53/189 |
| 4,033,088 | 7/1977 | Markert | 53/189 X |

*Primary Examiner*—Travis S. McGehee

*Attorney, Agent, or Firm*—Geoffrey R. Myers; William D. Hall

[57] ABSTRACT

A machine for packaging chickens in plastic bags comprising tong-like gripper means which engage the legs of a chicken as it comes from a conveyor, a hopper into which said gripper means force the chicken so that its legs come to lie at the side of the body, the hopper having a bottom adapted to be withdrawn in transverse direction, a plastic bag mounted below the hopper, being adapted to be inflated and held by supporting means to receive said chicken, the top of the filled bag being clamped by transporting clamps which guide it into means for gathering the top of the bag and closing it by a clip.

5 Claims, 8 Drawing Figures

MACHINE FOR PACKAGING CHICKENS

The present invention concerns a machine for packaging chickens and fowl.

In order to insert chickens into plastic bags their legs must be pushed towards the body and lie adjacent to it. This, up to now, has been done manually only, the knee joint of the chicken being crossed and inserted into an opening made in the skin of the belly of the chicken. After the bags are filled, they are closed either manually or automatically by means of clips or ties.

It is the object of the present invention to provide a machine whereby the thighs of a chicken, after the legs have been removed, are pressed toward the body of the chicken and then are automatically inserted into plastic bags, which are then closed automatically by mechanical means.

The invention consists in a machine for packaging chickens in plastic bags comprising:

a. grippers;
b. a hopper with a bottom adapted to be withdrawn;
c. inflating means for a plastic bag;
d. supporting means for the inflated plastic bag;
e. transporting clamps for the filled bag;
f. means for gathering the top of the bag and applying a clip thereto, said grippers supporting a chicken above its knee joints and forcing it into said hopper so that its thighs lie adjacent the body of the chicken, the chicken being allowed to fall in this condition into the inflated bag positioned below it, as the bottom of the hopper is withdrawn and the grippers are opened.

The invention is illustrated, by way of example only, in the accompanying drawings in which.

Figure 1:
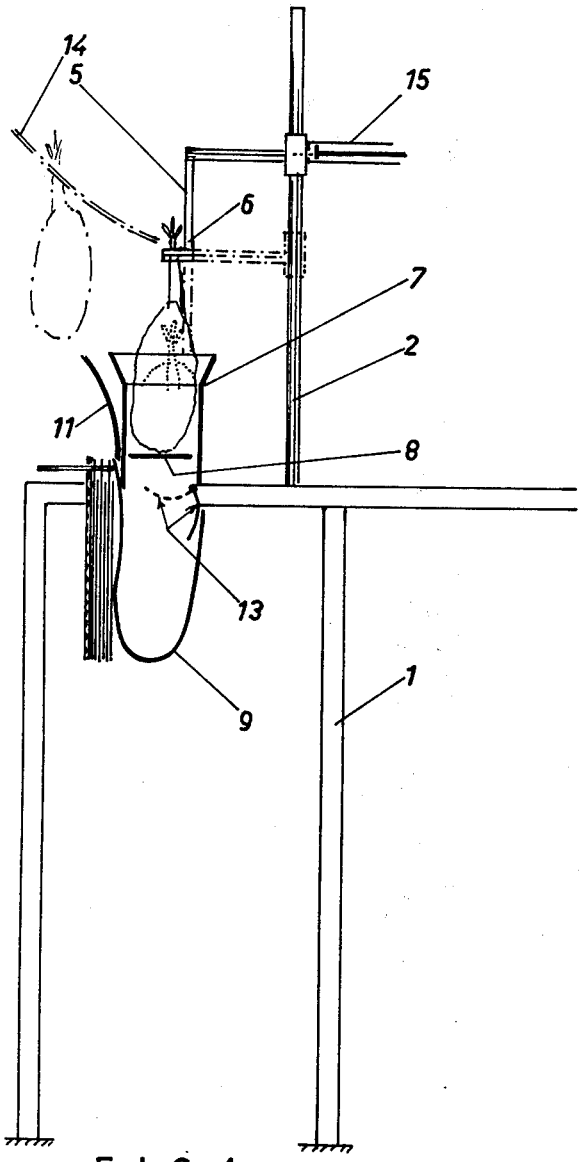
FIG. 1 is a side elevation of part of the machine according to the invention.
Figure 3:
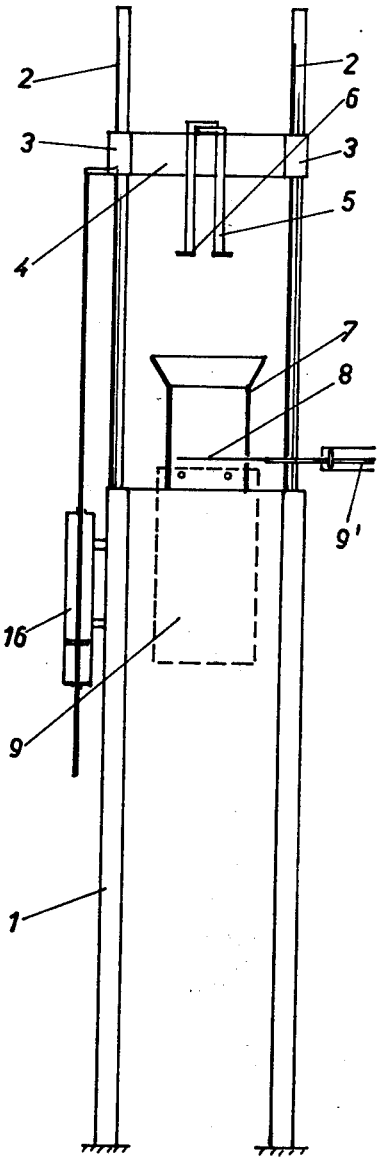
FIG. 3 is an end view thereof.
Figure 2:
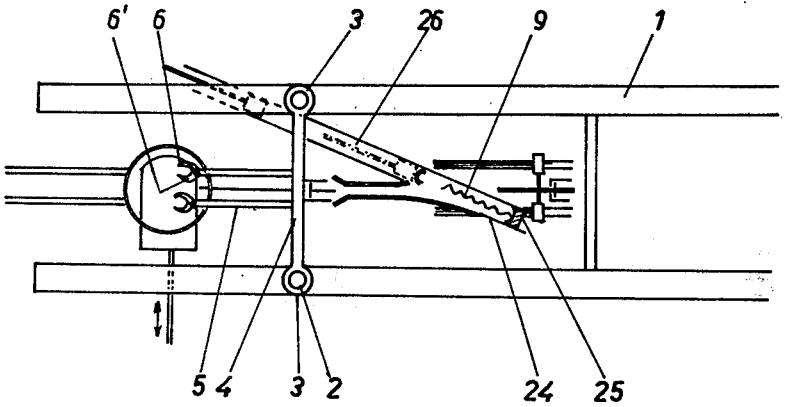
FIG. 2 is a plan view thereof.
Figure 4:
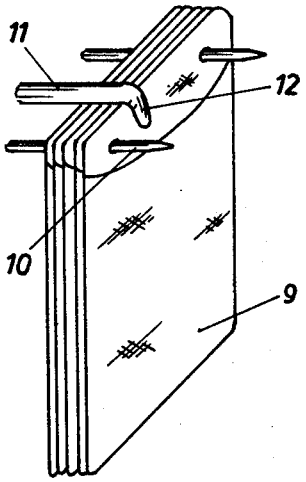
FIG. 4 shows in perspective view the plastic bag storage and inflating means.
Figure 5:
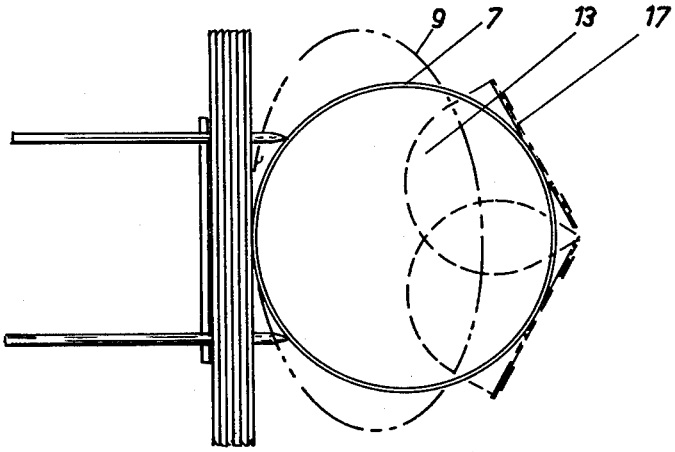
FIG. 5 is a plan view on an enlarged scale showing the supporting means for the plastic bag.
Figure 6:
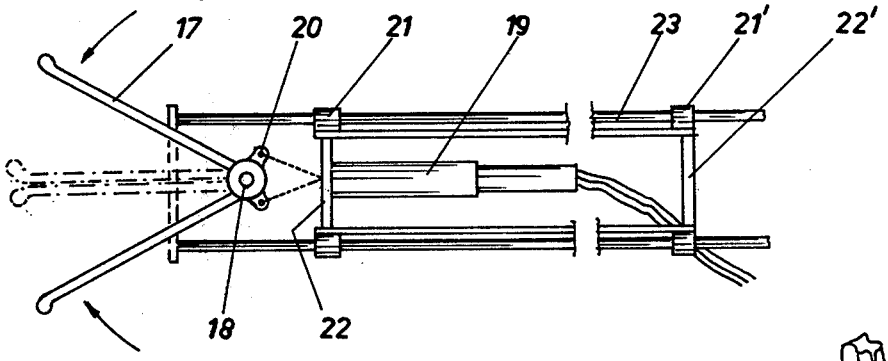
FIG. 6 is a plan view of the transporting clamps for the filled bag.

Referring to FIGS. 1 - 3, the chicken packaging machine according to the invention comprises a framework generally indicated by 1, having two upwardly extending parallel rods 2 on which sleeves 3 are slideable, the sleeves 3 being connected to each other by means of a cross bar 4. On said cross bar 4 two parallel grippers 5 are mounted, one jaw 6 of each gripper being movable relative the other one 6', so that said gripper can be closed or opened. The pair of grippers 6, 6' are vertically aligned with a stationary hopper 7 provided with a bottom 8 adapted to be withdrawn from said hopper by means of a piston 9'. Below said hopper and at one side thereof a supply of flat plastic bags 9 are positioned, being dependent from posts 10 by a transverse edge which protrudes above the other transverse edge of the bag. An air nozzle 11 extends above the supply of bags, its nozzle 12 pointing downward toward the outermost bag whereby when air is supplied therethrough it will cause the inflation of the outermost bag 9. Below said hopper 7, a pair of curved supporting flaps 13 are pivotally mounted, said flaps in their retracted position extending transversely below bottom 8 of the hopper and in their extended position depending downwardly in such a manner that they engage the side of an inflated bag 9 which lies opposite the posts 10 and pull the bag in a direction away from said posts.

Figure 7:
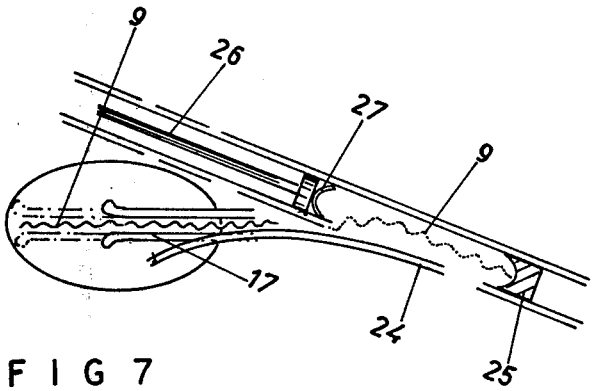
FIG. 7 is a partial plan view of the closing mechanism of the bag.
Figure 8:
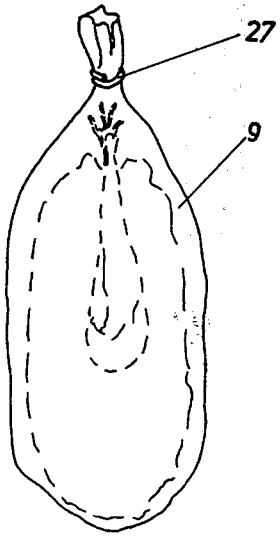
FIG. 8 shows an elevation of a closed filled bag.

The machine so far described works as follows:

The chickens are dependant from a supply conveyor 14 by their knee joints, said conveyor being mounted above and adjacent grippers 5 and supplying the chickens at predetermined intervals towards said grippers. A piston 15 actuates the gripper jaw 6, so that when a chicken is in a proper position above hopper 7, the chicken is transferred from conveyor 14 to gripper jaws 6, 6', whereafter piston 15 closes the jaws. A piston 16 now lowers sleeves 3 and cross bar 4 towards hopper 7, while bottom 8 is in position below said hopper. As sleeves 3 slide downward, a position which can be seen in dash-dotted lines in FIG. 1, the thighs of the chicken are forced against its body while the entire chicken abuts against bottom 8. In this position the flaps 13 extend transversely below bottom 8. Simultaneously, air is supplied through nozzle 12 and inflates a plastic bag. The bottom 8 is now withdrawn from the hopper by piston 9' and simultaneously flaps 13 are lowered to support bag 9, i.e. to stretch bag 9 somewhat while the grippers are made to release the knee joint of the chicken, so that the latter, after having been pushed by the grippers falls by gravity into the inflated bag 9. At this moment a number of operations of the machine are coordinated to happen simultaneously. Sleeves 3 and grippers 5 are moved upwardly to receive a new chicken, bottom 8 is slid under hopper 7 and flaps 13 are pivoted into their original position. In order to grasp and transport the filled bags, clamps 17 are provided. These clamps are constituted by two straight bars which are pivoted at 18 to each other and are adapted to clamp between them a filled bag 9. The clamping, i.e. the closing of the clamps 17 against each other is effected by a piston 19 actuating lugs 20 of clamps 17. The clamps 17 and piston 19 are mounted in a carriage constituted by two pairs of sleeves 21, 21' connected to each other by cross bars 22, 22' and being adapted to ride on parallel rods 23 mounted horizontally in the frame of the machine. Clamps 17 hold the bag between them and pull it away from mounting means 10, tearing it away therefrom while transporting it. The rods 23 extend at right angles to vertical rods 2 and the closed clamps 17 move horizontally. Below said guide rods 23, a stationary guide 24 is provided, which guide extends horizontally at an angle to the rods for the travel of said clamps in such a position, that the open end of said guide catches the top of the plastic bag below the closed clamps 17 (FIG. 7).

In cooperation with said guide the inner end of which is formed as an anvil 25 for a purpose which will become clear hereinafter, a drive member 26 is provided which is aligned with guide 24 and moves relative thereto, its front end being adapted to remove a clip 27 from a supply of clips (not shown). These clips 27 are in their open position and as they are moved by said drive member into guide 24 gather the bags 9 therein below the clamps 17 in which the top of the bag is still retained. The drive member 26, which is moved by a piston (not shown) forces a clip 27 against anvil 25 whereby said clip is made to surround the bag 9 near its top. Simultaneously, clamps 17 are opened by piston 19 to release the top of bag 9 and drive member 26 moves back so that the packed closed bag can fall downwards where it is collected (not shown).

The operation of the various pistons and the various parts of the machine are synchronized and controlled by any known means. Preferably electronic switches are provided where required and are actuated by the moving parts of the machine.

The movement of the various mechanisms described above may be effected by pneumatic or hydraulic means or by any other suitable mechanism.

It is, of course, understood, that the bag-filling means above described can be combined with any known closing means, if desired. The closing and tying of a closed bag may also be effected manually, if desired.

Furthermore, although the invention has been described for packaging chickens, it is to be understood that other products which may not require grippers for feeding them into the hopper, may be packaged by the machine according to the invention.

I claim:

1. A machine for packaging a chicken whose legs remain attached to its body into an inflatable plastic bag comprising: (a) means for gripping a chicken above its knee joints such that the body hangs downwardly therefrom, (b) a hopper located below said gripping means, said hopper being provided with a transversely removable bottom portion and an open upper end sufficiently large to receive a chicken therewithin, (c) means for lowering said gripping means a sufficient distance to insert the chicken into the hopper until the chicken contacts the bottom portion of said hopper and thereafter an additional distance to compress the legs against the body, (d) means for providing an open ended plastic bag below the bottom portion of said hopper with the open end of said bag in receiving condition under said bottom portion and (e) means for transversely removing the bottom portion of the hopper and deactivating the gripping means thereby to drop the chicken into said bag with its legs lying adjacent the body.

2. A machine according to claim 1 wherein said means for providing an open ended plastic bag comprises a pair of posts for supporting a supply of depending plastic bags by one protruding transverse edge and inflating means positioned above said bags for inflating the outermost bag.

3. A machine according to claim 2 wherein said bag providing means further includes pivotally arranged curved flaps mounted below said hopper and depending downwardly therefrom in such a way as to engage the said end of inflated bag and pull it in a direction away from said posts.

4. A machine according to claim 1 which further includes means for transporting the bag with the chicken located therein away from said hopper, said means comprising transporting clamps having two straight bars pivotally connected together and adapted to clamp the filled bag between them and transport it away from said hopper.

5. A machine according to claim 4 which further includes means for closing the bag once the chicken is dropped therein and means including means for gathering the top of the filled bag, which gathering means comprise a stationary guide extending at an angle below rods which guide the travel of said clamps, said guide having its inner end formed as an anvil, a driving member adapted to remove a clip from a supply and adapted to move relative said anvil and force the clip around the bag.

* * * * *